US006341719B2

(12) United States Patent
Villa

(10) Patent No.: US 6,341,719 B2
(45) Date of Patent: Jan. 29, 2002

(54) DISPENSING/METERING DEVICE FOR TWO-COMPONENT OR ONE-COMPONENT ADHESIVE

(75) Inventor: Giordano Villa, Vigolzone (IT)

(73) Assignee: Nordmeccanica S.p.A., Piacenza (IT)

( * ) Notice: Subject to any disclaimer, the term of this patent is extended or adjusted under 35 U.S.C. 154(b) by 0 days.

(21) Appl. No.: 09/849,639

(22) Filed: May 4, 2001

(30) Foreign Application Priority Data

May 8, 2000 (IT) ..... PC00A0016

(51) Int. Cl.[7] ..... B67D 5/00

(52) U.S. Cl. ..... 222/330; 222/134; 222/135; 222/144.5; 222/145.2; 222/146.5

(58) Field of Search ..... 222/134, 135, 222/137, 138, 144.5, 145.2, 145.5, 145.6, 145.7, 146.2, 146.5, 330, 566–568

(56) References Cited

U.S. PATENT DOCUMENTS 1,815,698 A * 7/1931 Bennett et al. ..... 222/330
2,555,563 A * 6/1951 Benton ..... 222/330
3,133,675 A * 5/1964 Broadhurst ..... 222/145.6
3,561,645 A * 2/1971 Hopkins ..... 222/146.2
3,705,596 A * 12/1972 Young ..... 222/144.5
4,407,431 A * 10/1983 Hutter, III ..... 222/135
4,456,151 A * 6/1984 Lewellen ..... 222/146.5
5,924,607 A * 7/1999 Yamada et al. ..... 222/146.2
5,979,794 A * 11/1999 DeFillipi et al. ..... 222/146.5
6,126,039 A * 10/2000 Cline et al. ..... 222/145.6
6,131,770 A * 10/2000 Allen ..... 222/330

* cited by examiner

*Primary Examiner*—J. Casimer Jacyna
(74) *Attorney, Agent, or Firm*—Notaro & Michalos P.C.

(57) ABSTRACT

The invention relates to a metering device comprising:

a base plate (1) fitted with heating means (25) and a pipe (7) which connects two openings, at least one (4) of which is located on the upper wall of the said plate two or more tanks (2, 2') designed to rest on the plate, which are fitted with a connector (5) designed to be inserted into the said pipes metering means (8) designed to be connected to the other end of the said pipes (7) to convey the product from the interior of the said tanks through the said plate; the outlet of the said metering means (8) leading to a dispensing head (10) which contains two chambers (28, 29), connected to feed devices that convey the adhesive from each tank, while two nozzles (32, 33) connect the said chambers to two outlets, one of the said chambers (28) also being connected to a second pipe (37) which dispenses the adhesive.

13 Claims, 3 Drawing Sheets

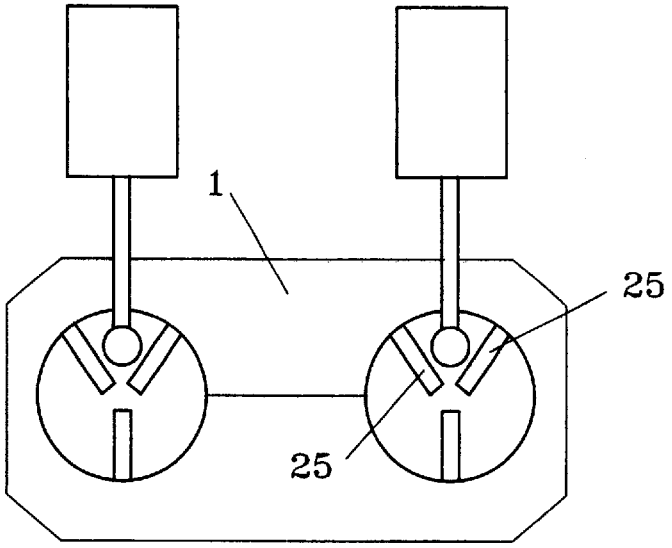
Fig. 6
Fig. 5
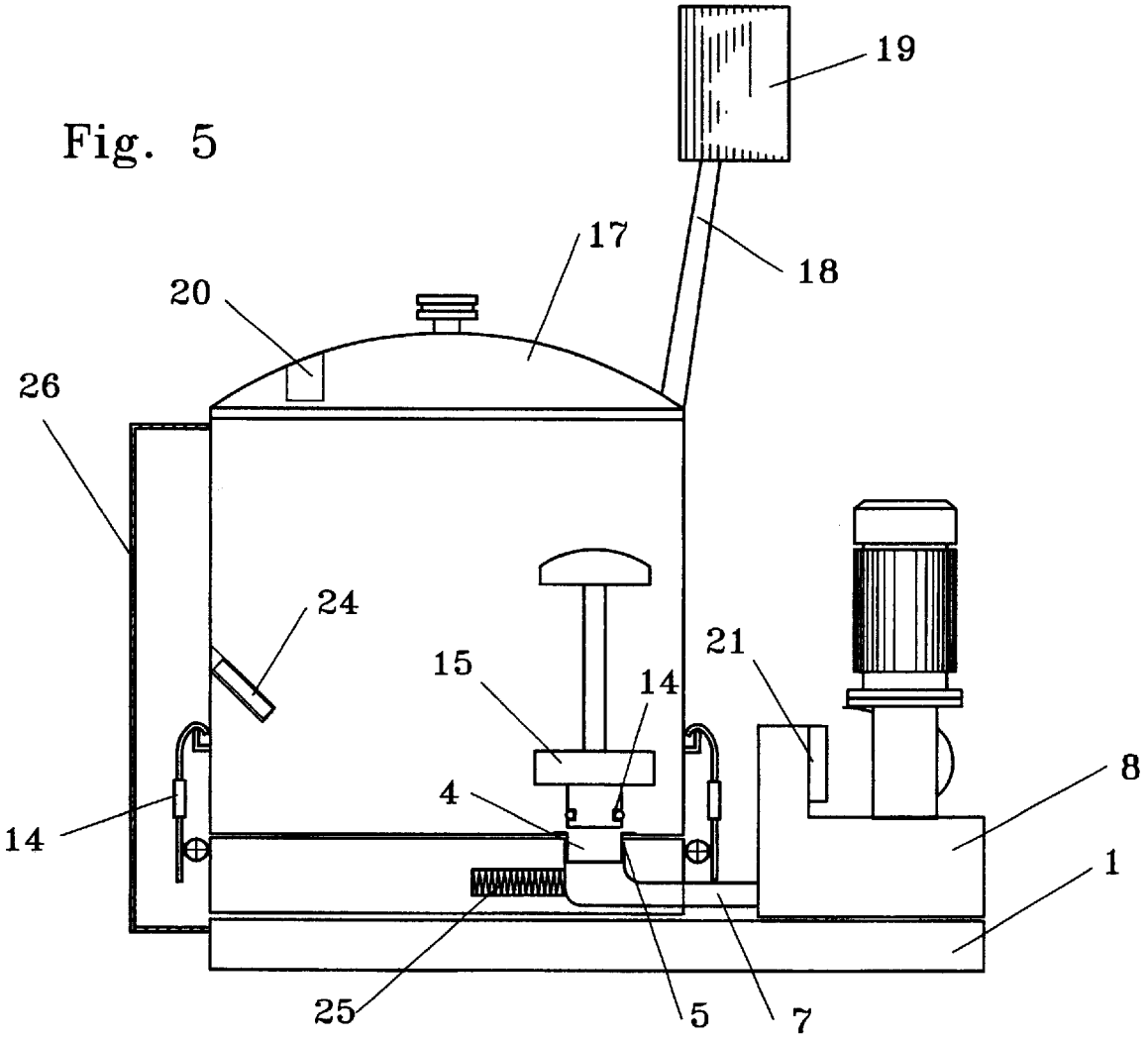

DISPENSING/METERING DEVICE FOR TWO-COMPONENT OR ONE-COMPONENT ADHESIVE

BACKGROUND OF THE INVENTION

This invention relates to a dispensing/metering device for two-component or one-component adhesive, which is designed for use particularly, but not solely with film bonding machines.

In accordance with one aspect of the invention, two tanks are fitted to contain the component(s), namely resin and hardener in the case of two-component adhesive, whereas a single tank can be used in the case of one-component adhesive.

These tanks are fitted to a heated support in such a way that they can easily be removed, so that heat is transmitted to the products through the base of the containers.

In accordance with another aspect of the invention, the level of the components in the tanks is monitored by an ultrasound sensor, thus avoiding the use of mechanical devices, which would be difficult to clean when the type of adhesive is changed.

The result is a much simpler device than those already known, which is functional and eliminates practically all the down time required for cleaning of tanks when changing from one type of adhesive to another.

The known devices used to measure out and dispense adhesive are equipped with fixed tanks for the products that constitute the adhesive, the tanks being heated by a resistor fitted inside a jacket which surrounds the side wall of each tank.

Each tank is connected to a pump which conveys the required amount of product to a mixer, where the two components are mixed before use.

These machines are completed by various accessories, including float devices which monitor the product level in the tanks.

A metering device of this kind is known from the Italian patent application N° PC 98A 028 of the same inventor. However, these machines present a considerable drawback when the time comes to change over from one type of adhesive to another; the machine has to be shut down for a considerable time to allow thorough cleaning of the tanks and the devices inside them, so as not to contaminate the new products with residues of the previous ones. This is a fairly long, inconvenient and difficult operation which, as mentioned, requires the machine to be shut down for several hours in order to perform sufficiently thorough cleaning. The same problem also applies to cleaning of other parts of the machine, especially the dispensing nozzles, which have a complex shape and are therefore difficult to clean as thoroughly as necessary, with the result that when the type of adhesive is changed, the operators often replace the dispensing head as well as cleaning the machine because of the difficulty of cleaning the head properly. This drawback is now solved by the present invention, which offers a metering device for both two-component and one-component adhesive, in which the tank or tanks that contain the adhesive are fitted removably on a heated plate so that they can easily be removed or replaced with other tanks containing the new product, and can be thoroughly washed at a distance from the machine.

The machine in accordance with the invention also has an innovative dispensing head which can be used with either two-component or one-component adhesives, and can easily be cleaned thoroughly.

BRIEF DESCRIPTION OF THE DRAWINGS

This invention will now be described in detail, by way of example but not of limitation, with reference to the annexed figures in which:

FIG. 5 is a vertical cross-section of the device in accordance with the invention FIG. 6 is a schematic plan view of the device in accordance with the invention.

DETAILED DESCRIPTION OF THE INVENTION

Figure 1:
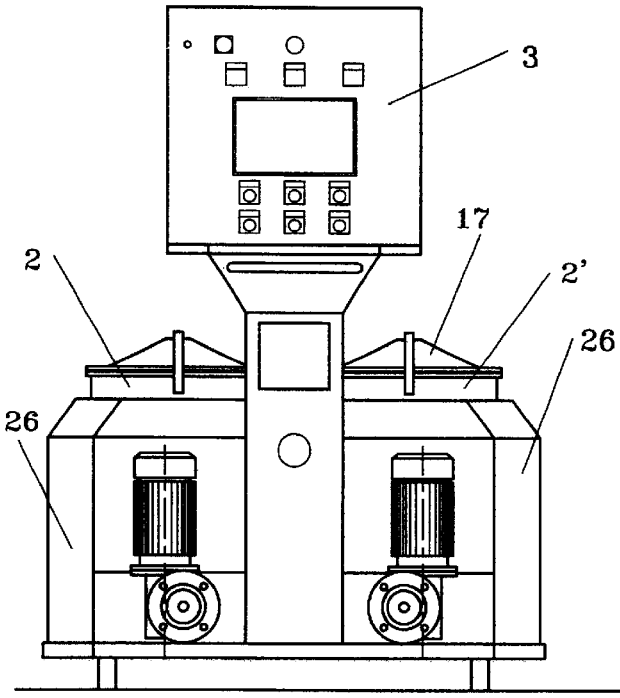
FIG. 1 is a view of a device in accordance with the invention
Figure 2:
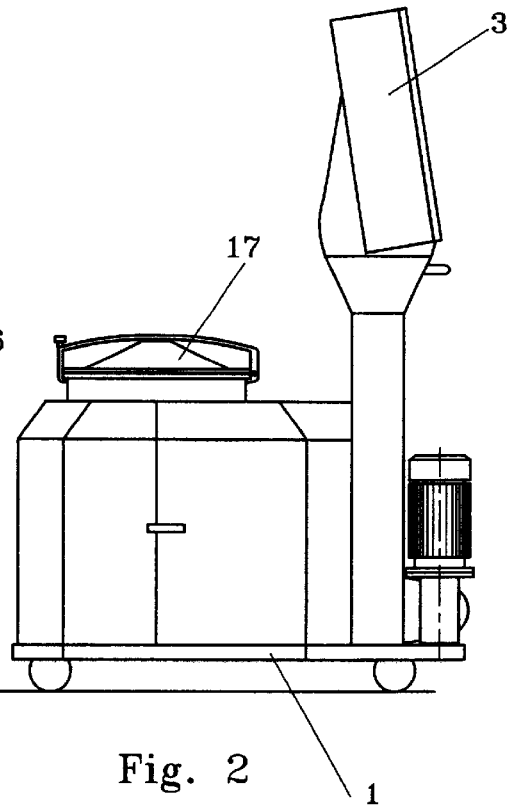
FIG. 2 is a side view of the device shown in FIG. 1
Figure 3:
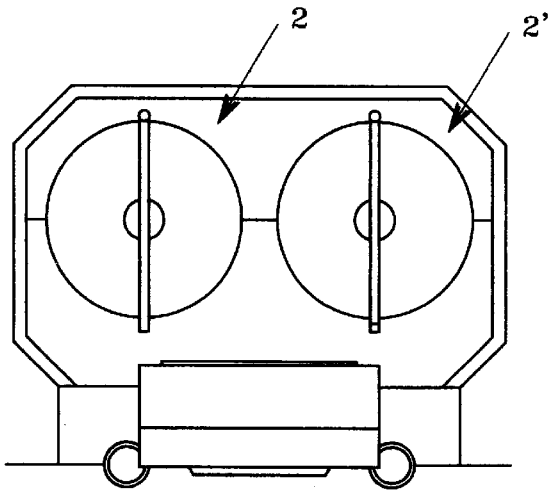
FIG. 3 is a plan view of the device in accordance with the invention

With reference to the annexed figures, the device basically comprises a base 1, which also constitutes the adhesive heating plate, on which a pair of tanks 2 and 2' are mounted. Each of the said tanks contains one of the components of the mixture in the case of two-component adhesive, and the said components are pumped out and metered by devices which will be described below.

In the case of one-component adhesive, one of the tanks could be bypassed, and the corresponding pump with associated control electronics and heating devices could also be bypassed with a selector switch.

The said selector switch could also select the tank from which the adhesive is pumped.

A control unit 3, containing a PLC or an analog computer, controls the functions of the machine and the various units of which it is composed.

In particular, there is a hole 4 in heated base 1 in correspondence with each tank 2 and 2' into which is inserted a connector with a suitable gasket such as an O-ring or the like, the said connector being fitted to the base of the tank.

Hole 4 leads on the opposite side to a pipe 7 which is connected to the inlet of a motorised metering pump 8, in particular a gear pump, the outlet of which is connected to a product dispensing head 10.

Each tank can be secured to baseplate 1 with a set of snap hooks 14 of known type or the like, and a cap 15 with an O-ring 16 is fitted to close the bottom of the tank.

Tank 2 is closed by a lid 17 to which a pipe 18 leads from a container 19 filled with moisture-absorbing material such as silica gel; the air which penetrates into the tank passes through the said moisture-absorbing material as the level of the product in the tank falls.

Lid 17 also contains an ultrasound sensor 20 designed to monitor the level of the product in the tank and send a corresponding signal to control unit 3.

A membrane pressure sensor 21 is connected to the outlet of each pump 8, and is also connected to control unit 3.

A temperature sensor 24 is positioned in a seating in the wall of tank 2.

A plurality of heating elements are inserted in baseplate 1; in this specific case they are constituted by electrical resistors 25, but they could also be constituted by any heating device of known type.

Preferably, as illustrated in FIG. 6, at least one pair of resistors 25 is located in the immediate proximity of hole 4 through which the product exits from the tanks, and is thus immediately heated.

The tanks and the various distribution pipes are enclosed in a casing 26 lagged with a suitable layer of heat insulation material which is secured around the tanks to prevent heat dispersion and maintain a suitable temperature in the tanks.

Finally, the pipes which convey the adhesive component to the dispensing head are also suitably provided with heat insulation means, which may include heating means such as an electrical resistor.

Figure 4:
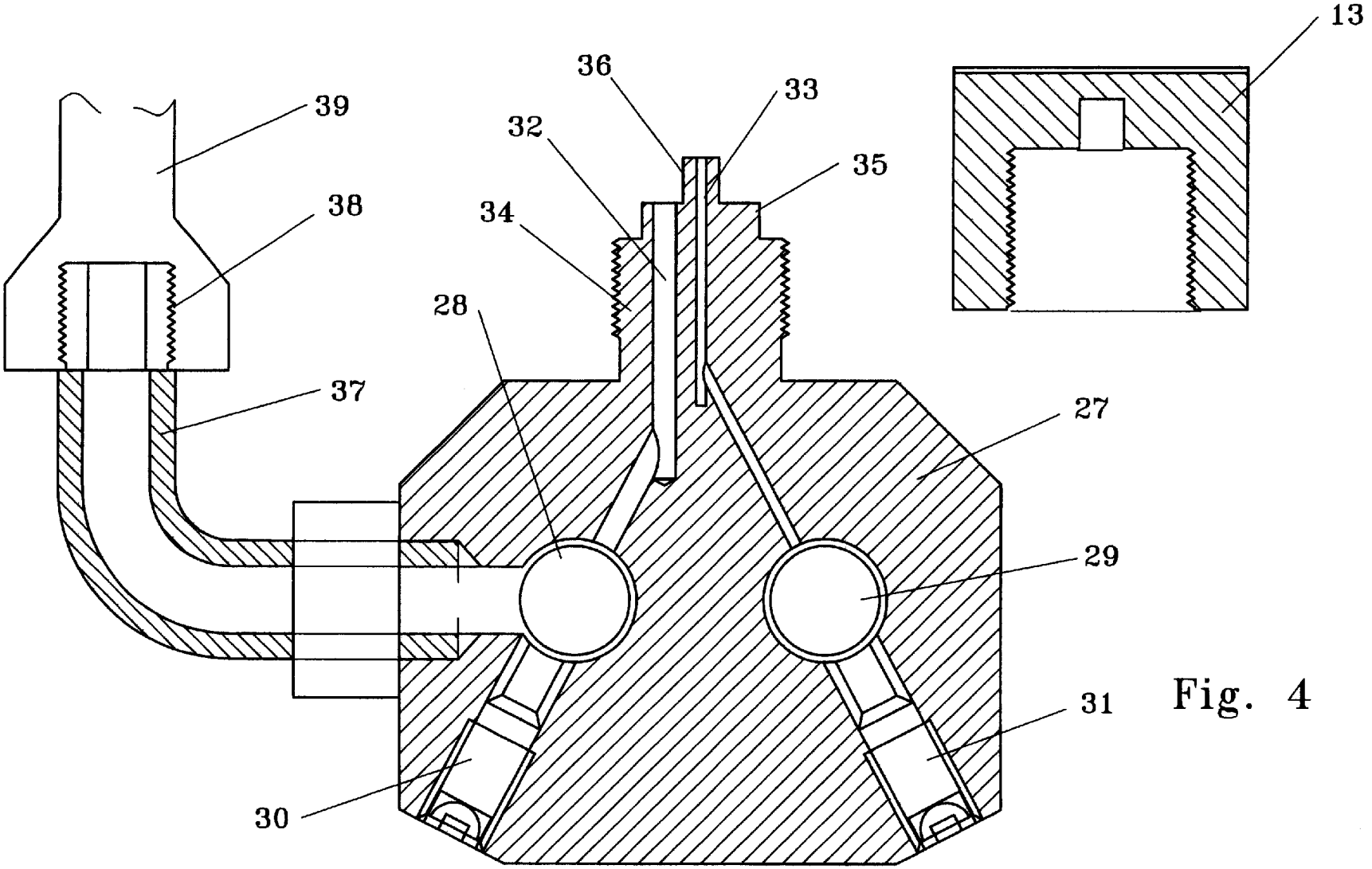
FIG. 4 is a cross-section of the dispensing head in a device in accordance with the invention

Dispensing head 10 is illustrated in detail in FIG. 4.

The said head comprises a body 27 with a pair of inlets or chambers 28 and 29 fitted with connectors, not shown in the figure, for the pipes leading from tanks 2 and 2' which contain the components of the adhesive.

A pair of inspection and cleaning pipes 30 and 31, each closed by a cap, lead to chambers 28 and 29.

Pipes or nozzles 32 and 33 lead from chambers 28 and 29 to a connector 34 on head 10.

The end of connector 34 presents two consecutive lengths 35 and 36 of a different diameter. Nozzles 32 and 33 lead to the end walls of these lengths 35 and 36 respectively.

Connector 34 is threaded, and a closing cap 13 is screwed to it. The shape of the end wall of the said cap 13 complements that of the end of connector 34, so that it rests against the end wall of the latter and seals nozzles 32 and 33.

An outlet pipe 37, with a thread 28 for fitting a dispensing syringe or the like 39, leads to one of chambers 28 and 29; in the case illustrated in the figure it leads to chamber 28. Chamber 28 is connected to the adhesive tank when a one-component adhesive is used.

The device operates as follows.

To prepare the device for operation, it is sufficient to fit the tanks to plate 1, insert connector 5 into hole 4, and secure the tanks with snap hooks 14. When the tanks are filled with the required products, they can be closed with hermetically sealing lid 17, and the machine is switched on. Resistors 25 heat plate 1, from which heat is transmitted to the product through the bottom of the tanks; the temperature of the product is monitored by sensor 24, which transmits the data to the control unit.

At the same time pumps 8 are activated to pump the product from the bottom of the tanks and convey it through hole 4 and pipe 7 to dispensing head 10. The speed of the pumps can be independently regulated to allow perfect metering of the two fluids when they are discharged.

In the case of two-component adhesive, the two components reach chambers 28 and 29, from which they are dispensed through nozzles 32 and 33 which lead to connector 34, to which dispensing syringe 39 is fitted.

In the case of one-component adhesive, cap 13 is screwed to connector 34, thus sealing nozzles 32 and 33 to prevent hardening of the product, and dispensing syringe 39 is fitted to connector 38 on outlet pipe 37, from which the adhesive conveyed from the tank to chamber 28 is dispensed.

If cleaning operations are necessary, it is sufficient to connect to connector 38 or 34 devices able to pump a cleaning fluid such as a solvent, and to remove the closing caps from inspection pipes 30 and 31.

If the fluid is pumped through nozzles 32 and 33, thorough cleaning can be performed easily and quickly, and all debris is removed, exiting through inspection pipes 30 and 31, which are of larger diameter. When the type of adhesive needs to be changed, it is no longer necessary to shut down the machine before a thorough tank cleaning operation can be performed; it is sufficient to loosen snap hook 14 and remove the tanks, which can thus be cleaned conveniently at a later stage. When the pipes have been washed with a suitable solvent, the tanks containing the new adhesive can be attached, and the machine started up again.

An expert in the field could devise numerous modifications and variations, all of which should be deemed to fall within the scope of this invention.

What is claimed is:

1. Metering device for two-component or one-component adhesive, of the type which comprises one or more tanks (2, 2') for the components of the adhesive, means (25) designed to heat the said adhesive, and independently regulated means (8) designed to convey the required amount of adhesive from each tank, further including a dispensing head (10) which contains two chambers (28, 29), connected to feed devices that convey the adhesive from each tank, and two nozzles (32, 33) which connect the said chambers to two outlets, one of which chambers (28) being also connected to a second pipe (37) which dispenses the adhesive.

2. Metering device as claimed in claim 1, wherein the said dispensing nozzles (32, 33) lead to a connector (34) fitted with means designed to allow the application of a cap (13) which closes the said nozzles.

3. Metering device as claimed in claim 2, wherein the said dispensing nozzles (32, 33) lead to an end wall of the said connector (34), and the said cap (13) blocks the said nozzles when fitted to the said connector.

4. Metering device as claimed in claim 1, wherein the said outlet pipe (37) is fitted with a connector (38) designed to allow the application of a dispensing syringe (39).

5. Metering device as claimed in claim 1, wherein the said tanks (2, 2') are removable and the said heating means are constituted by a support plate (1) with resistors (25) on which the said tanks rest.

6. Metering device as claimed in claim 5, comprising:

a baseplate (1) fitted with heating means (25) and a pipe (7) which connects two openings, at least one (4) of which is located on the upper wall of the said plate;

two or more tanks (2, 2') designed to rest on the plate, which are fitted with a connector (5) designed to be inserted into the said pipes;

metering means (8) designed to be connected to the other end of the said pipes (7) to convey the product from the interior of the said tanks through the said plate;

the outlet of the said metering means (8) leads to a dispensing head (10) which contains two chambers (28, 29), connected to feed devices that convey the adhesive from each tank, while two nozzles (32, 33) connect the said chambers to two outlets, one of the said chambers (28) also being connected to a second pipe (37) which dispenses the adhesive.

7. Metering device as claimed in claim 6, wherein the said metering means (8) are constituted by gear pumps.

8. Metering device as claimed in claim 7, wherein the said heating means are most concentrated close to the said pipes which convey the product from the tanks.

9. Metering device as claimed in claim 7, wherein rapid coupling means (14) are fitted to secure the said tanks to the said heated plate.

10. Metering device as claimed in claim 7, further including membrane pressure sensors (21) located at the outlet of the said pumps (8), which send a signal indicating the fluid pressure to a control unit (3) which controls the device.

11. Metering device as claimed in claim 10, characterised in that it includes a temperature sensor (24) housed in a seating in the tank wall, which said sensor detects the temperature of the adhesive components and sends a corresponding signal to a control unit of the apparatus.

12. Metering device as claimed in claim 6, further comprising ultrasound sensors (20) to monitor the product level in the tanks.

13. Metering device as claimed in claim 12, in which the said ultrasound sensors are located in the tank lids (17).

* * * * *